US005626526A

United States Patent [19]

Pao et al.

[11] Patent Number: 5,626,526

[45] Date of Patent: May 6, 1997

[54] GOLF TRAINING DEVICE HAVING A TWO-DIMENSIONAL, SYMMETRICAL OPTICAL SENSOR NET

[76] Inventors: Yi-Ching Pao, 1586 Hyde Dr., Los Gatos, Calif. 95030; Mark V. Weckwerth, 128 Seale Ave., Palo Alto, Calif. 94301-3729

[21] Appl. No.: 422,067

[22] Filed: Mar. 31, 1995

[51] Int. Cl.[6] ..... A63B 69/36

[52] U.S. Cl. ..... 473/156; 473/152; 473/155; 473/198; 473/199

[58] Field of Search ..... 273/35 R, 32 R, 273/183.1, 185 A, 185 B, 186.1, 186.3, 187 R, 433–434, DIG. 28, 181 R, 181 H; 364/371, 410; 473/155–156, 150–152, 409, 180, 198, 199

[56] References Cited

U.S. PATENT DOCUMENTS

| | | | |
|---|---|---|---|
| 3,727,069 | 4/1973 | Crittenden, Jr. et al. | 273/371 |
| 3,759,528 | 9/1973 | Christophers et al. | 273/185 R |
| 4,136,387 | 1/1979 | Sullivan et al. | 273/185 R |
| 4,150,825 | 4/1979 | Wilson | 273/181 H |
| 4,343,469 | 8/1982 | Kunita et al. | 273/185 A |
| 4,437,672 | 3/1984 | Armantrout et al. | 273/181 H |
| 4,542,906 | 9/1985 | Takase et al. | 273/181 H |
| 4,563,005 | 1/1986 | Hand et al. | 273/181 H |
| 4,652,121 | 3/1987 | Ito et al. | 273/185 R |
| 4,770,527 | 9/1988 | Park | 273/181 H |
| 4,949,972 | 8/1990 | Goodwin et al. | 273/181 H |
| 5,024,441 | 6/1991 | Rousseau | 273/185 R |
| 5,230,505 | 7/1993 | Paquet et al. | 273/371 |
| 5,277,426 | 1/1994 | Gerpheide et al. | 273/185 R |
| 5,333,874 | 8/1994 | Arnold et al. | 273/181 H |
| 5,342,054 | 8/1994 | Chang et al. | 273/186.1 |
| 5,390,927 | 2/1995 | Angelos | 273/181 R |
| 5,401,026 | 3/1995 | Eccher et al. | 273/186.1 |
| 5,479,008 | 12/1995 | Nishiyama et al. | 273/181 H |

*Primary Examiner*—Jessica Harrison
*Assistant Examiner*—Mark A. Sager
*Attorney, Agent, or Firm*—Jeing & Chang

[57] ABSTRACT

The present invention relates to a golf training device capable of forming a two-dimensional, single planar and total symmetrical optical sensor net for detecting movement of a golf ball. The device comprises a square frame which has a signal producing means holding part on the first horizontal and the first vertical sides of the frame and a signal detecting means holding part on the second horizontal and the second vertical sides of the frame. On the signal producing means holding part, a light signal producing means including a light signal emitting means is installed to generate a two-dimensional, single planar optical path net. A light signal detecting means is spatially arranged in the opposite sides of the frame in accordance with the light emitting means to form a totally symmetrical optical sensor net for detecting the light signals from the light signal producing means. The present invention also includes a golf ball sensor means for detection of the golf ball movement at its initial impact and a data processing and display means which receives and processes output signals from the light signal detecting means for calculating the golf ball's take-off speed, the horizontal and vertical angles, and the trajectory distance. The square frame can be modified to an "U" or "Π" shape to eliminate the upper frame of the sensor net and to reduce the dimensions of the training device.

26 Claims, 16 Drawing Sheets

GOLF TRAINING DEVICE HAVING A TWO-DIMENSIONAL, SYMMETRICAL OPTICAL SENSOR NET

FIELD OF THE INVENTION

The present invention relates to an improved golf training device. More specifically, it relates to a golf training device capable of generating multiple optical paths from a single light source to form a two-dimensional, single planar optical sensor net for detecting movement of a golf ball impacted to display data on the ball.

BACKGROUND OF THE INVENTION

Golf is a sport which challenges a player's skills in golf ball control with respect to its traveling directions and distances. Since an impacted golf ball demonstrates the characteristics of trajection movements, it is theoretically feasible to predict its movement based on the trajectory principles. It is therefore desirous to have a device capable of detecting and displaying data on a traveling golf ball based on these principles.

There have been some golf training devices that addressed this need. U.S. Pat. No. 4,146,230 provided a simple golf training device, i.e., a golf swing reforming device, for the detection of the movement of a club head. This device, however, did not generate data based on the actual movement of a golf ball.

While U.S. Pat. No. 4,542,906 disclosed a computer aided golf training device capable of detecting movement of a ball immediately after it was impacted by a club head, this device, however, has certain limitations as it may cause some inaccurate determinations for the trajectory movement of a golf ball. For instances, there is a detection-blind area between the light signal producing means holding part and the light signal detecting means holding part of that device in which the impacted ball will be traveling undetectedly due to the asymmetrical arrangements of the light emitting source and light signal detecting elements on said holding parts. In addition, detection errors may be occurred if the ball travels in a direction closer to the light emitting source so that a single crossing signal will simultaneously activate more than one light detecting elements due to the use of a divergent light source by this device. Furthermore, if the golf ball taking off at a very small vertical angle, calculations of this angle by this device is practically impossible or otherwise inaccurate because the spatial difference between the intercepting points of the ball with the first and the second light producing signals is insignificant to support such calculations.

The light emitting sources of an optical net may vary in types. For instance, the traditional infrared (IR) touch screen technology uses multiple IR emitting diodes (LED) to form a transmitting optical array. This technology would require a lots of LEDs if a relatively larger optical net is constructed to cover a large illumination area. Since the LED is not a coherent light source as the laser, the distance between the LED transmitters and detectors can not be too far because the optical signals between the adjacent transmitter-detector pairs may overlap to cause inaccurate detection. This limited factor may be correctable only if individual LED is independently focused to reduce signal overlapping or modulated so each LED light can be distinguished. These approaches lead to a much higher cost and more complicated design, and are not practical or too costly in constructing a golf training device whose optical net is intended to cover a large area, i.e., 4 to 8 feet or so.

It is therefore an object of the present invention to overcome the disadvantage of the above-mentioned device and to provide a golf training device capable of performing the calculation of a variety of relevant data by a simple and in a highly accurate manner.

It is a further object of the present invention to provide a golf training device capable of forming a laser-based, two-dimensional, single planar and highly symmetrical optical sensor net for detecting movement of a golf ball impacted to display data on the ball.

SUMMARY OF THE INVENTION

The present invention relates to a golf training device capable of forming a two-dimensional, single planar and highly symmetrical optical sensor net for detecting movement of a golf ball impacted to display data on the ball.

One aspect of the present invention is to provide for a golf ball sensor means placed on the reference axis of the golf ball traveling direction for detection of the golf ball movement at its initial impact.

Another aspect of the present invention is to provide for a square frame which has a signal producing means holding part on the first horizontal and the first vertical sides of the frame and a signal detecting means holding part on the second horizontal and the second vertical sides of the frame. The first horizontal and vertical sides form a right angle diagonally opposed to the right angle formed between the second horizontal and vertical sides. On the signal producing means holding part of the frame, a light signal producing means including a light signal emitting means is placed on the first horizontal and vertical sides to generate a two-dimensional, single planar optical path net within which the light signals in any area in which the golf ball may intercept have substantially the same density. The light signal producing means may comprise two focused laser beams, one is placed on the first horizontal side and the other on the first vertical side of the frame. Alternatively, the light signal producing means may comprise a single focused laser beam and an optical spliter. The optical spliter is capable of splitting the light signals produced by the single laser beam equally to the light signal emitting means located on the first horizontal and the first vertical sides, respectively. A preferred light signal emitting means comprises a series of glass slides or similar functioning elements equally spaced at a predetermined distance smaller than the diameter of a golf ball to transmit and emit light signals produced by the laser beam. The principle of using the invented light reflecting elements to generate multiple laser beams is not only useful for this particular application (i.e., Golf training) but also valuable to all kinds of optical sensor net applications such as touch screen display, etc.

One more aspect of the present invention is to provide for a light signal detecting means, including means to output a detection signal. The light signal detecting means comprises a plurality of light sensitive elements such as, but not limited to, detectors which are placed on the signal detecting means holding part of the second horizontal and vertical sides of the frame. The detecting means is spatially arranged on the opposite sides of the frame in accordance with the light emitting means to form a highly symmetrical and equally, spatially sensitive optical sensor net for detecting the light signals from the light signal producing means. The sensor net may be varied in sizes to accommodate a trainer's special circumstances. Preferably, the optical net can be constructed in various sizes ranging from 2 to 8 feet without compromising its detection accuracy.

One another aspect of the present invention is to provide for a golf ball stopping net placed further along the golf ball traveling direction at the rear side of the frame for golf ball stopping.

Still one more aspect of the invention includes a data processing and display means which may further include an electronic monitor and an optional screen projector. The primary function of process and display means is to receive and process output signals from the light signal detecting means based on the movement of golf ball and display data generated on the electronic monitor. The process and display means is also capable of projecting pictures resembling a golf course onto the golf ball stopping net to simulate the field conditions.

Still another aspect of the invention is to provide for a simplified method for calculating golf ball traveling with respect to its take-off speed, the horizontal and vertical angles, and the trajectory distance based on the information provided by the two-dimensional, symmetrical optical sensor net of the present invention.

Still one further aspect of the invention is to provide for a simplified golf training device whose upper frame is eliminated to allow full clearance of swinging club and to reduce the distance between the tee and the optical sensor net. This "U-shape" or "Π" shape device is still capable of generating a symmetrical optical net if the X-Y coordinates are rotated for 45 degree by placing the optical elements on the two vertical and/or the bottom sides of the device The foregoing objects and specific construction of the present invention will become apparent and understandable from the following detailed description thereof, when read in conjunction with the accompanying drawings.

DETAILED DESCRIPTION OF THE INVENTION

Figure 1:
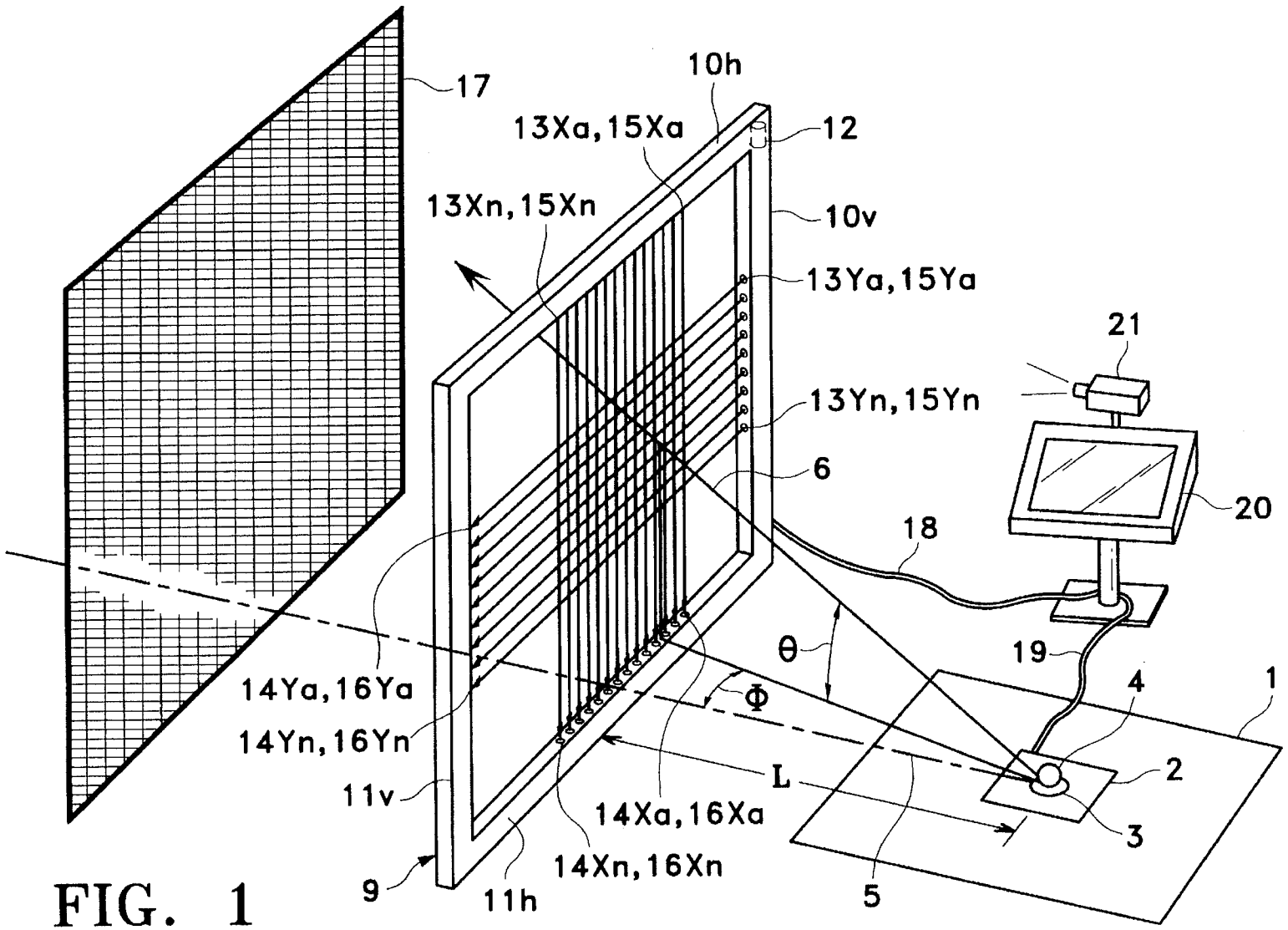
FIG. 1 is a slant view of the golf training device of the present invention.

Referring to FIG. 1, there is shown a slant view of the golf training device. The reference numeral 1 designates a lawn-like mat placed at a distance in front of the square frame, or the so-called optical sensor net 9 which comprises a first horizontal and a first vertical sides as well as a second horizontal and a second vertical sides as described later. The numeral 2 designates a golf ball sensor pad mounted through the mat 1 for detecting the golf ball movement at its initial impact by a golf club. The tee 3 is set up through the mat 1 to hold the golf ball 4. The numeral 5 designates a center line, drawn from the tee 3 to the square frame 9, as a reference axis for golf ball traveling. The numeral 6 designates an ideal ball traveling line whose projection from the top is in alignment with the center line 5. The square frame or the optical sensor net 9 is placed further along the golf ball traveling direction with respect to the golf ball sensor pad 2. The numerals 10*v* and 10*h* designate a signal producing means holding part located respectively on the first vertical and the first horizontal sides of the square frame. The signal producing means holding part has a hollow portion which accommodates a light signal producing means 12 and a light signal emitting means which comprises a plurality of equally spaced photo emitting units 13Xa . . . 13Xn and 13Ya . . . 13Yn located respectively on the first horizontal and the first vertical side of the light signal holding means holding part at a predetermined distance between them smaller than the diameter of a golf ball described later jointly in FIGS. 2 and 3.

The numerals 11*v* and 11*h* designate a signal detecting means holding part located respectively on the second vertical and the second horizontal sides of the frame. The signal detecting means holding part has a hollow portion in which a light signal detecting means 14 is accommodated. The light signal detecting means comprises a plurality of photosensitive units or detectors 14Xa . . . 14Xn and 14Ya . . . 14Yn located respectively on the second horizontal and the second vertical side of the signal detecting means holding part which are spatially arranged in a symmetrical manner in accordance with the photo emitting units 13Xa . . . 13Xn and 13Ya . . . 13Yn so that each of the photo emitting units is symmetrically opposing to each of the photosensitive units to form a two-dimensional, single planar and totally symmetrical optical sensor net within which each of the possible golf ball intercepting points may be irradiated with substantially the same light density, and thus gives rise to an evenly accurate calculation of ball movement regardless where the ball may intercept the optical net.

The numerals 15Xa . . . 15Xn and 15Ya . . . 15Yn designate respectively a plurality of through holes located on the first horizontal and the first vertical sides of the light signal emitting means and 16Xa . . . 16Xn and 16Ya . . . 16Yn designate respectively a plurality of through holes located on the second horizontal and the second vertical sides of the light signal detecting means for letting beams emitted from the photo emitting units pass therethrough to be received by the photosensitive units or detectors. The numeral 17 designates a golf ball capture net placed further along the golf ball traveling direction with respect to the golf ball sensor pad 2 and at the rear side of the optical sensor net 9 for ball stopping. The numeral 20 designates a processing/display device for performing calculations and processing of data outputted from the golf training device with respect to golf ball movement during the training session. The numerals 18 and 19 designate cables which connect the optical sensor net 9 and the golf ball sensor pad 2 respectively with the processing/display device 20. The numeral 21 designates an optional projector which can project golf course images onto the ball capture net 17 to simulate the field conditions.

Figure 2:
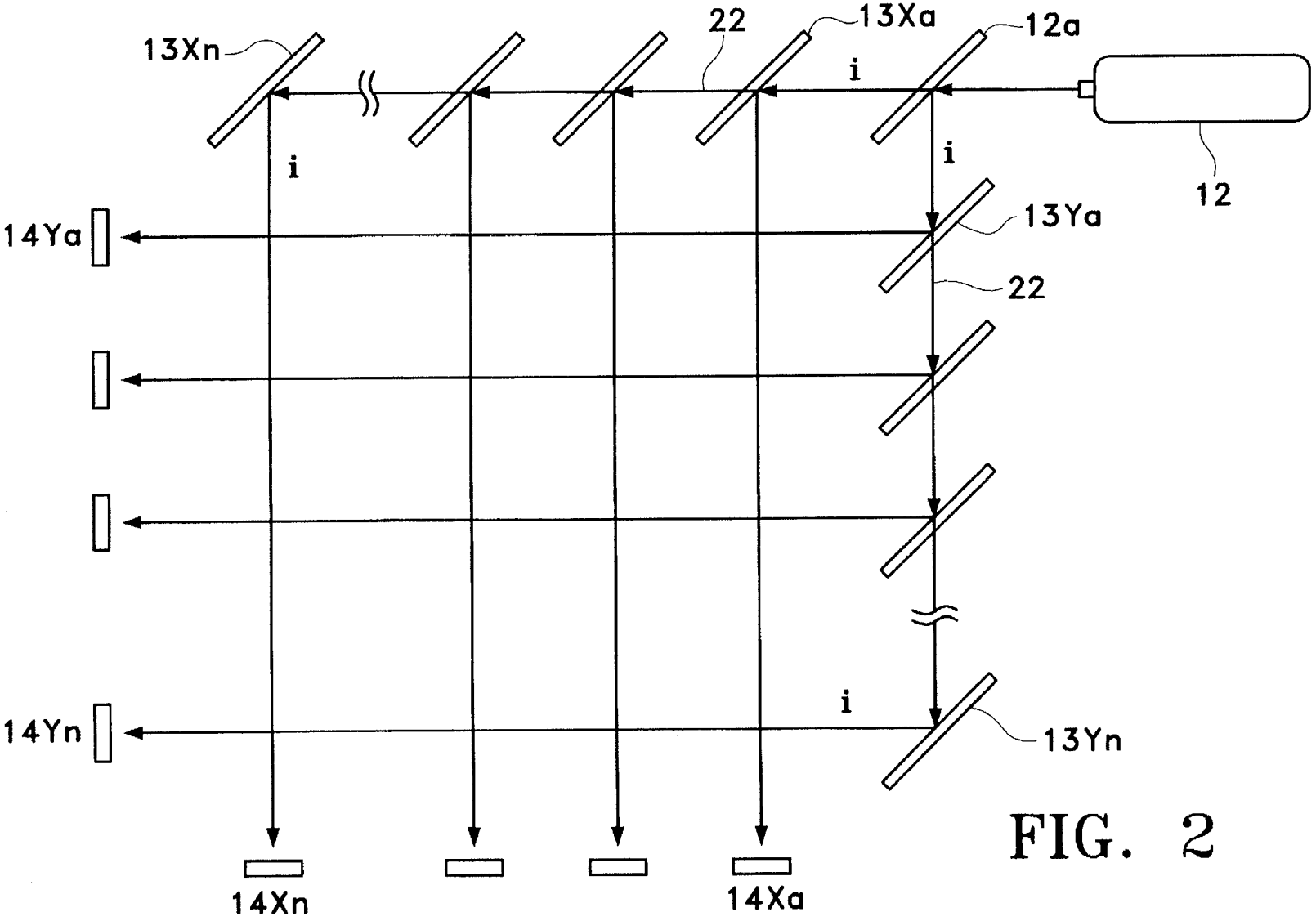
FIG. 2 is for illustrating how to construct the two-dimensional and symmetrical optical sensor net provided by the present invention.
Figure 3:
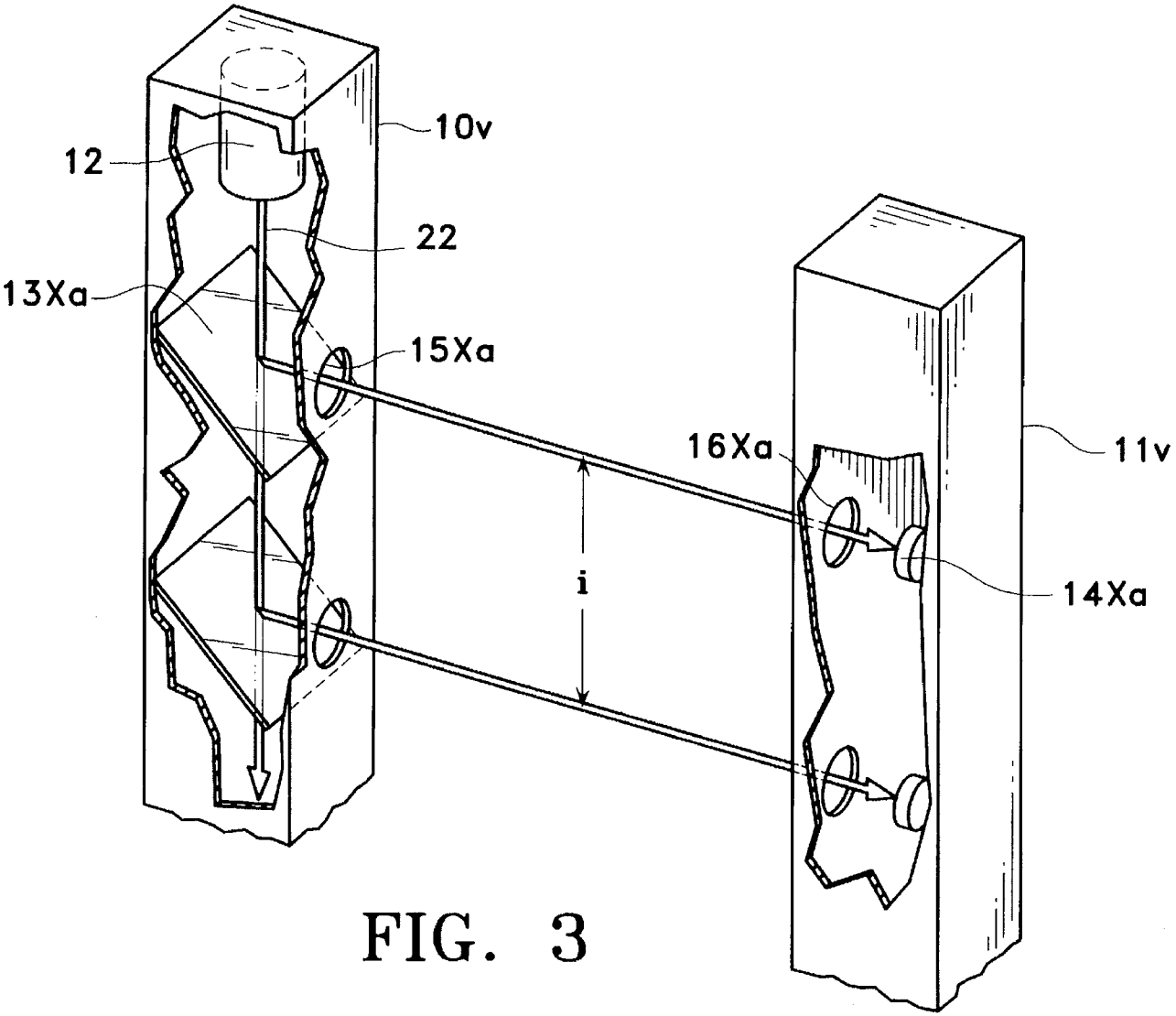
FIG. 3 illustrates the arrangements and mounting of the laser beam and detectors on the frame.
Figure 4:
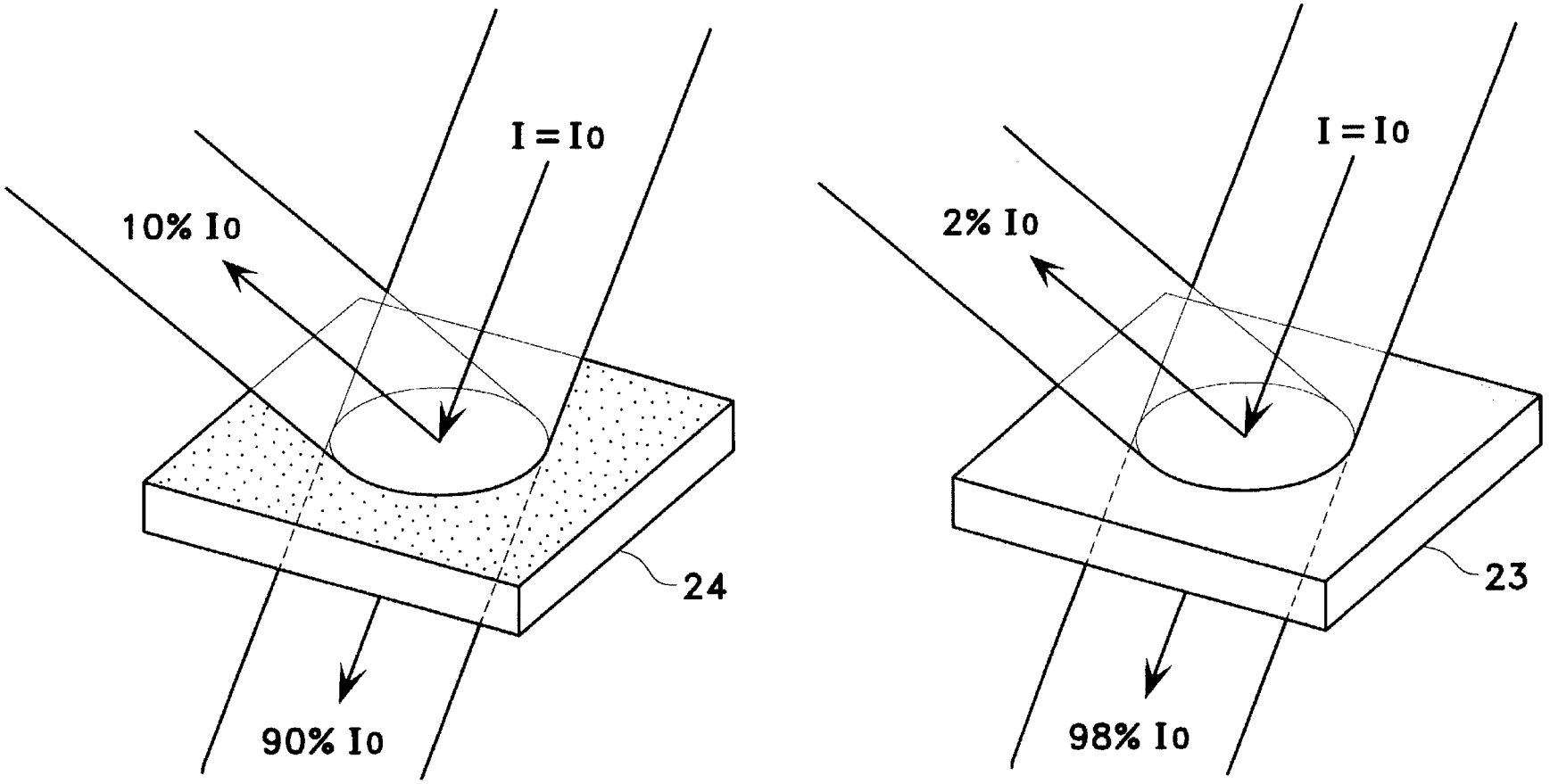
FIG. 4 illustrates the ways to obtain different laser intensity reflection through different glass slide anti-reflection coatings.
Figure 5:
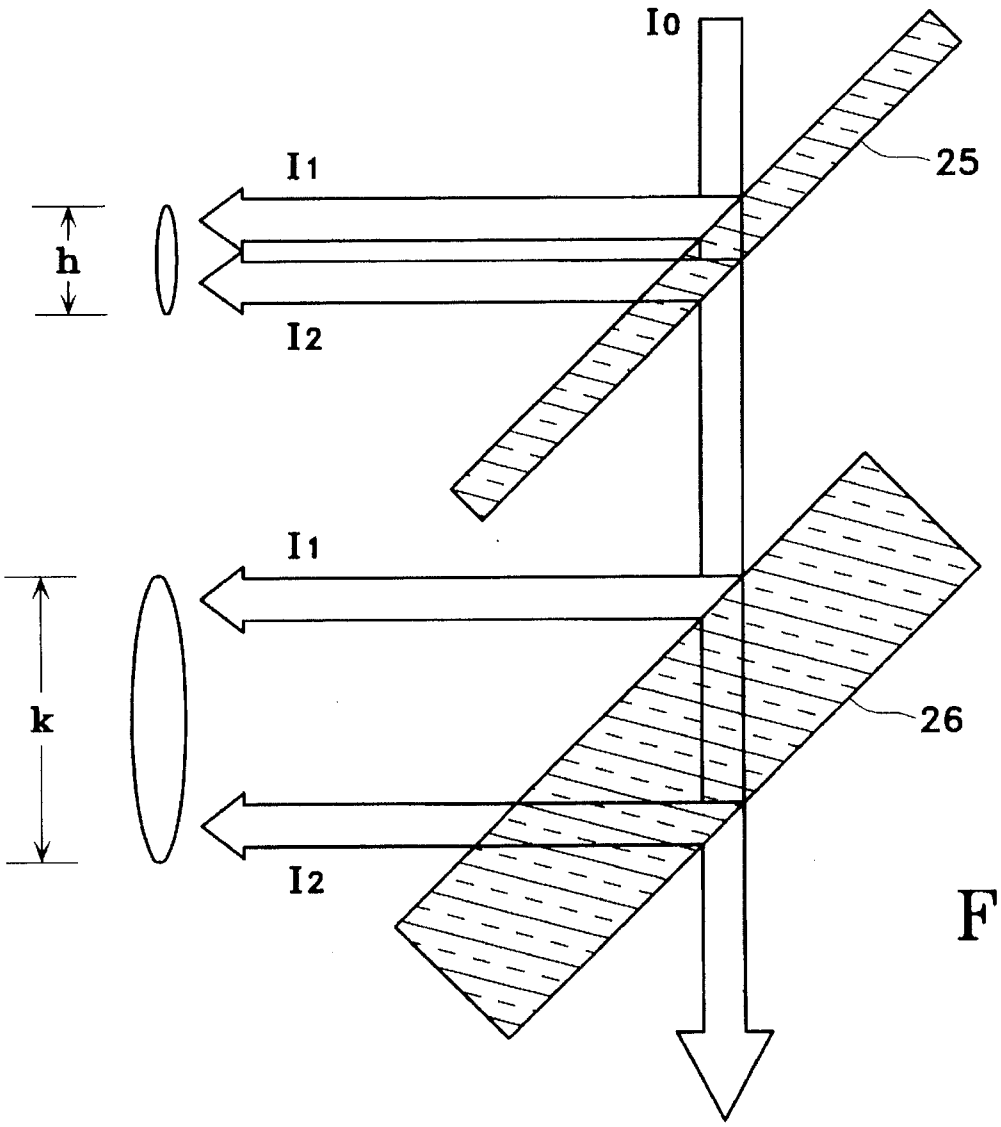
FIG. 5 is a diagram showing the relationship between laser light divergence due to multiple reflection and the thickness of the glass slide.

Referring now jointly to FIGS. 2, 3 and 5, the construction of the two-dimensional, symmetrical light optical net including the light signal producing means and light signal detection means are further described in details. The numeral 12 designates the light signal producing means which may comprise two focused laser beams, one located on the first horizontal side and the other on the first vertical side of the frame (not shown in FIG. 2). Preferably, the light signal producing means only comprises a single focused laser beam coupling with an optical splitter 12*a* whose function is to split the light signals produced by the single laser beam equally between the light emitting means located on the first vertical and the first horizontal sides of the frame so that one single laser beam can be used to produce light signals having substantially the same intensity on either of the vertical and horizontal sides. The photo emitting units 13Xa . . . 13Xn may be a plurality of glass slides, or like devices capable of reflecting and/or transmitting light signals on the horizontal side of the light signal emitting means. The photo emitting units 13Ya . . . 13Yn may be a plurality of glass slides, or the like devices on the vertical side of the light signal emitting means. The glass slides are adjustably mounted on the light signal producing means holding part 10 at a predetermined angle, preferably 45 degree, with respect to an optical axis 22 that has reference to the laser beam transmitted through the glass slides. Either the angle can be adjusted or other steps can be adopted as described in FIGS. 4 and 5 to determine how much laser beam should be reflected by each glass slide. Additionally, the glass slides on each side are mounted parallel with a predetermined interval i among them so as to generate a multiple yet parallel optical paths having substantially similar intensity.

Still referring jointly to FIGS. 2, 3 and 5, the numerals 14Xa . . . 14Xn and 14Ya . . . 14Xn designate a plurality of photosensitive units or detectors located respectively on the second horizontal and the second vertical sides of the light detecting means holding part 14. These detectors are arranged parallel each other on their respective sides of the signal detecting means holding part and are symmetrically opposed to the glass slides to form a two-dimensional, single planar and totally symmetrical optical sensor net. As shown in FIG. 5, the density of the optical net is dependent on the number of glass slides and detectors which are equally spaced on their respective sides by a predetermined interval smaller than the diameter of a golf ball. Since each point of the optical net receives substantially the same irradiation coverage, the present invention therefore provides a much more precise and accurate calculation for the golf ball movement regardless where the golf ball may intercepted with the net.

Referring now jointly to FIGS. 4 and 5, several methods, in addition to that of adjusting the angle of the glass slides, can be adopted to modulate the intensity of the laser reflection. The numerals 23 and 24 respectively designate glass slides coated with different anti-reflection coatings. Assuming that the coated glass slides 23 have a reflection coefficient of 2%, the first of these coated slides will reflect 2% of the laser power, Io, and permit 98% of the laser power transmitted through the glass and reach the second glass slide. The second glass slide will reflect 2%×98% of the transmitted laser light which is 1.96% of the original laser power. The third glass slide will reflect 2%×96.04% and so on. Likewise, if the coated glass slides 24 have a reflection coefficient of 10%, the first slide will reflect 10% of the laser power, Io. The subsequent slides will reflect 10%×90% and so on. Consequently, one can manipulate the laser intensity reflection through different glass slide reflectivity coatings to construct an optical net with desirable equally distributed laser power.

In order to minimize the potential of laser light divergence, thinner glass slides are preferred over thicker glass slides. As illustrated in FIG. 5, the numeral 25 designates a thin glass slide which may cause a primary reflection I1 and a secondary reflection I2. Since a thinner glass slide gives rise to a smaller h (i.e., the distance between the first and second reflection lines), this arrangement will reduce and minimize the formation of multiple reflections so as to permit more laser energy to be received by detectors with finite diameter. In contrast, if a thicker glass slide is used as the one designated in 26, the distance k between the primary reflection I1 and the secondary reflection I2 is much wider to increase the potential of forming multiple reflections which will reduce the laser energy received by the detectors unless some expensive prisms are used to replace the relatively inexpensive glass slides. Using the above described methods, one can also improve the signal-to-noise ratio caused by other illumination sources such as sunlight through use of special wavelength filters and modulation of laser intensity reflections. Alternatively, this can be achieved by using a pulsed laser as the light source.

Figure 6:
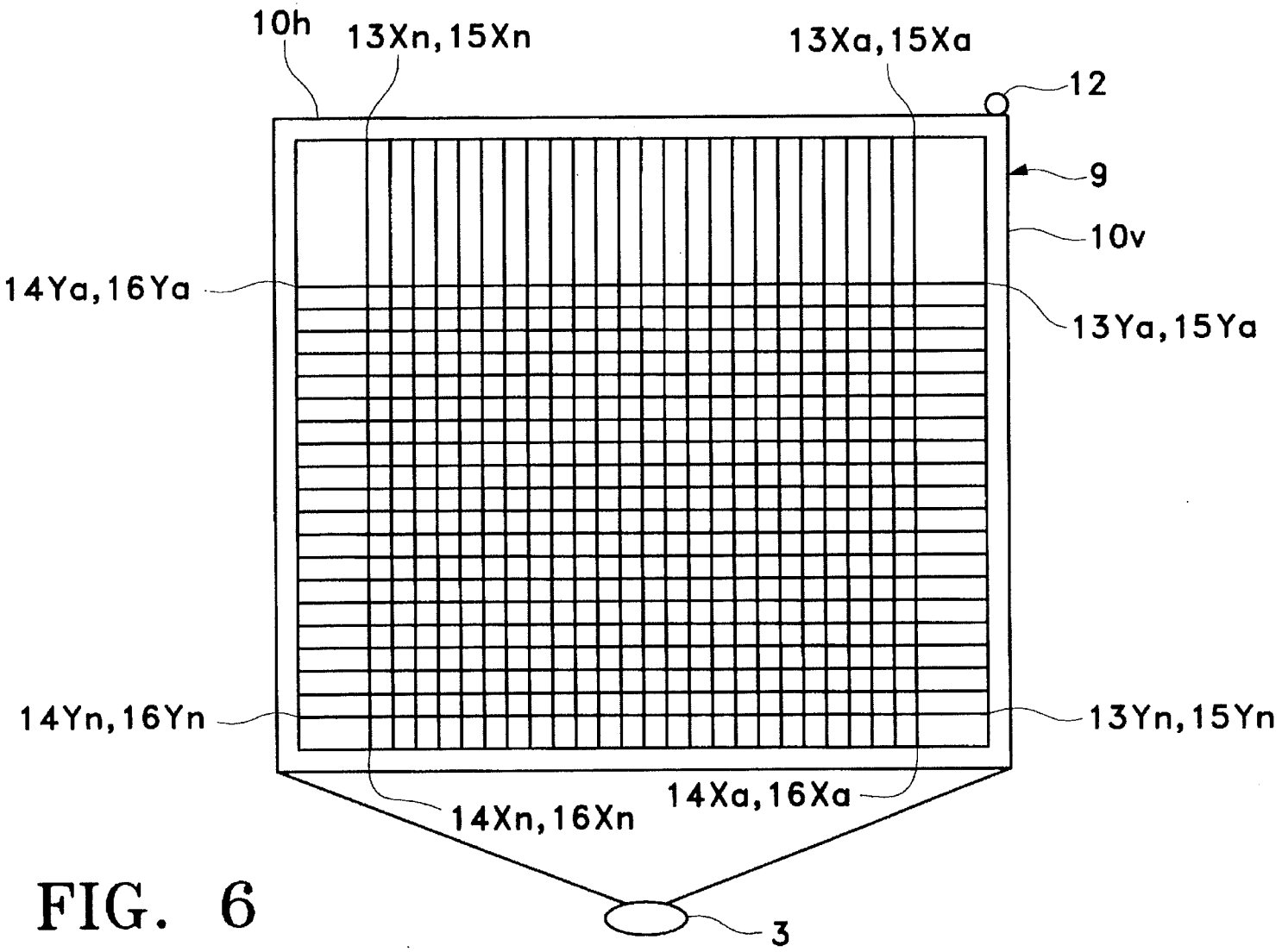
FIG. 6 is a diagram illustrating the X-Y axial symmetrical configuration of the optical net.
Figure 7:
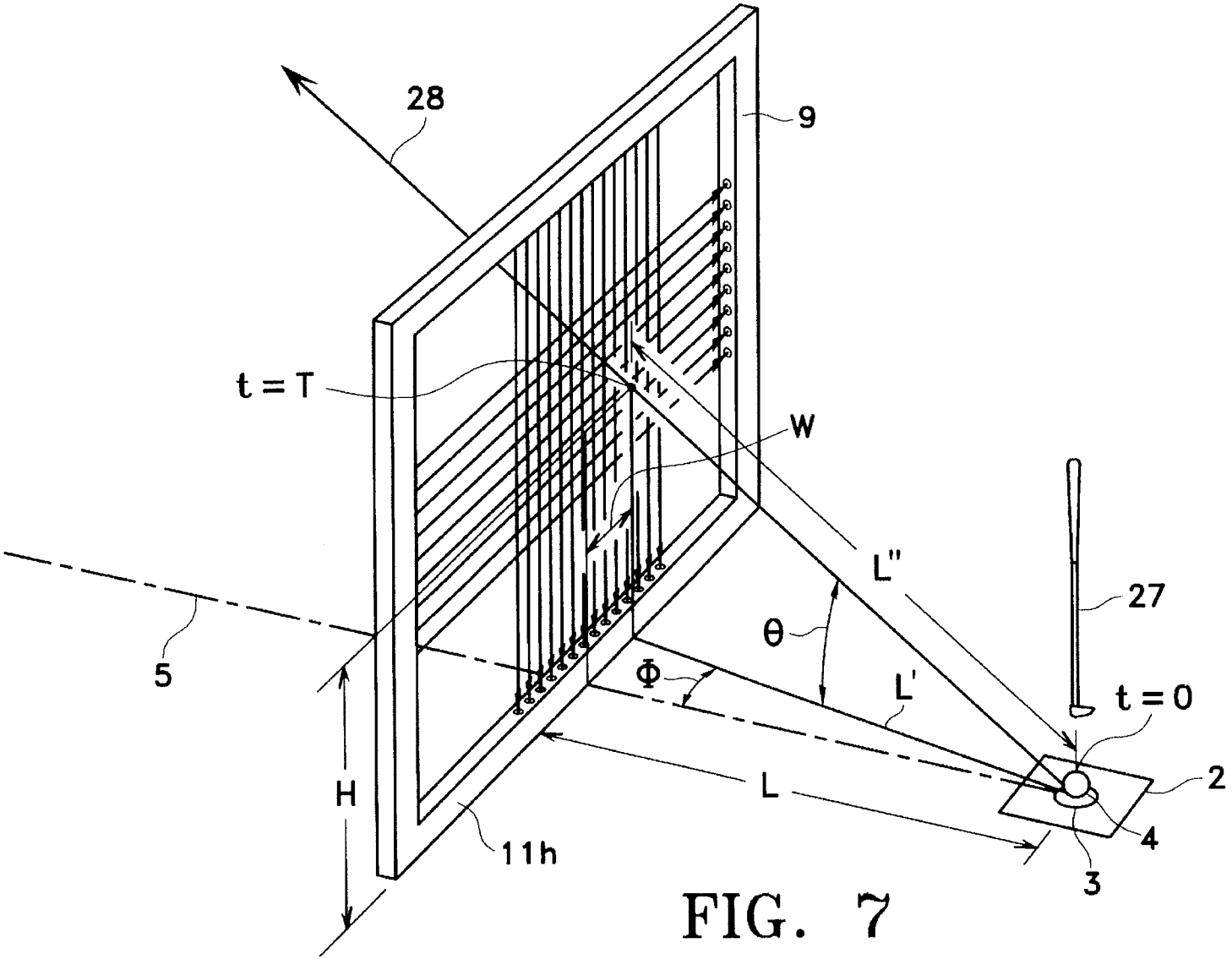
FIG. 7 is a drawing showing the principle for the trajection angle and the take-off speed calculations for the ball.
Figure 8:
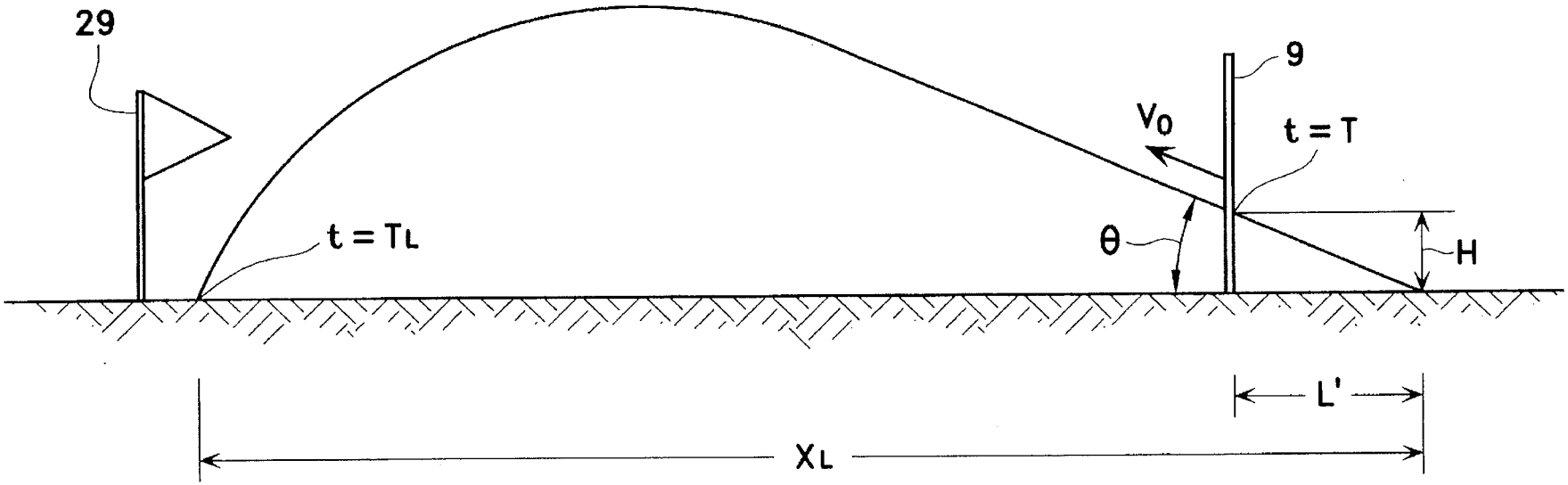
FIG. 8 is a diagram showing the principle for calculation of the traveling distance and the angle of a golf ball in the vertical direction.
Figure 9:
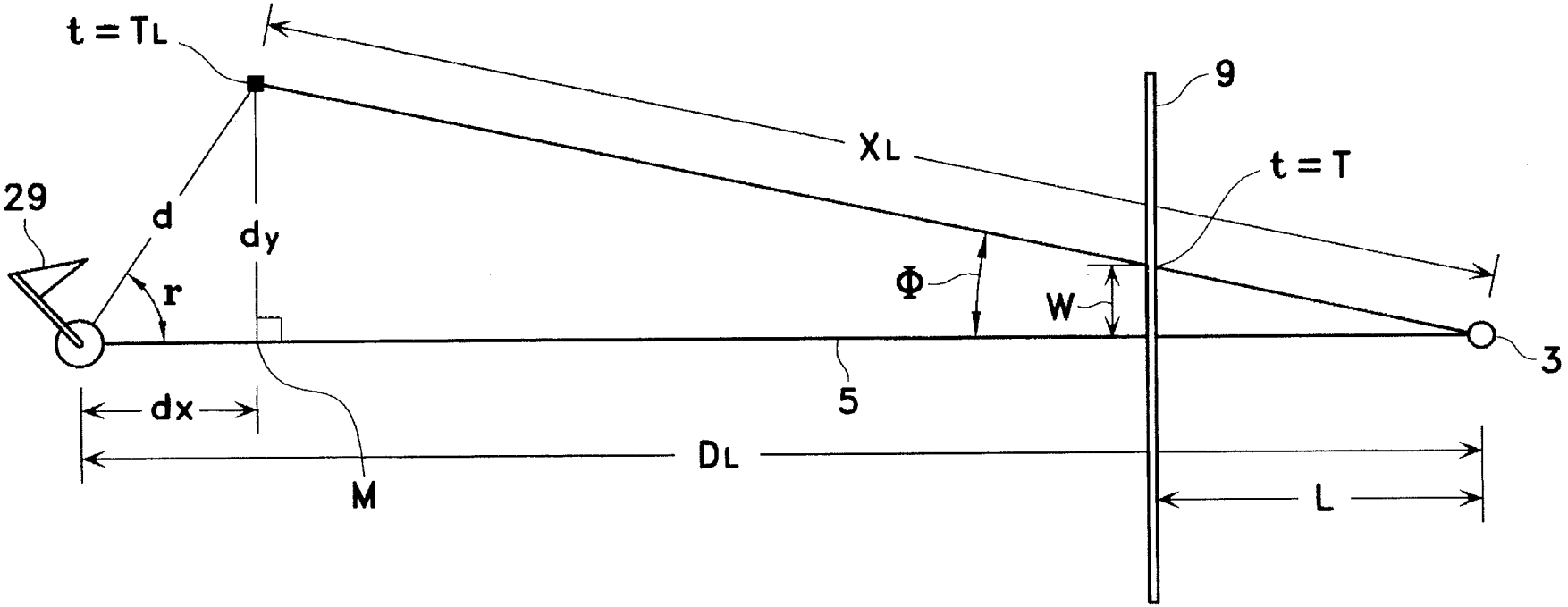
FIG. 9 is a diagram showing the principle for calculation of the angle and ball traveling deviation in the horizontal direction.

Referring now jointly to FIGS. 7, 8, and 9, the principle of the present invention will be discussed with respect to the calculations of the velocity of the ball, the trajection angles and the projected landing distance in relations to the two-dimensional, total X-Y and symmetrical optical sensor net as illustrated in FIG. 6.

As shown in FIG. 7, the numeral 5 designates the center line which is the target direction for golf ball traveling. The numeral 28 designates a trajectory which is the ideal golf ball traveling line in relation to the golf ball target direction. When the ball is initially impacted by a golf club, the ball sensor pad 2 at point t=0 marks the time as 0.00 second. When the ball travels through the optical net located at a distance L" from point t=0, it intercepts at least one horizontal (X-axis) and one vertical (Y-axis) optical paths on the net. The crossing point is denoted as point t=T (which indicates that the time required for the ball to travel from point t=0 to point t=T is T second.) and a X-Y coordinate is assigned for point t=T according to the optical paths the ball intercepted. Based on this information, the ball trajectory 28 and the landing point, as well as the initial take-off speed Vo, the vertical take-off angle θ and the horizontal spacial angle ϕ with respect to the center line 5 can be readily calculated and projected.

Referring further to FIG. 7, L' designates the horizontal traveling distance for the golf ball at the point t=T, the letter H designates the vertical traveling distance for the golf ball at the point t=T, and L designates the horizontal traveling distance for a golf ball if it is traveling along the ideal ball traveling direction as defined by the center line 5. The letter W designates the deviation in distance of the impacted golf ball from the central line. The following equations are therefore used for the calculation of the initial velocity Vo, the vertical angle θ and the horizontal angle ϕ:

$$L' = \frac{L}{\cos\phi} \tag{1}$$

$$L'' = \frac{L'}{\cos\theta} = \frac{L}{\cos\phi\cos\theta} \tag{2}$$

The golf ball take-off speed, Vo, can then be expressed as follows:

$$Vo = \frac{L''}{T} = \frac{L}{T\cos\phi\cos\theta}\text{, and} \tag{3}$$

$$\phi = \tan^{-1}\frac{W}{L}\text{, and } \theta = \tan^{-1}\frac{H\cos\phi}{L} \tag{4}$$

Referring to FIG. 8, it is generally known that the trajection speed of a traveling ball is determined by two velocity components at the X-Y coordinate, namely Vx and Vy, respectively, wherein Vx is equal to Vo cos θ, and Vy is equal to Vo sin θ. Thus, at any given time t, its x and y coordinate can be calculated by the following equations:

$$Tx=(Vo\cos\theta)t \tag{5}$$

$$Ty=(Vo\sin\theta)t-\tfrac{1}{2}gt^2\text{, wherein } g=32\text{ ft/sec}^2 \tag{6}$$

Assuming at the point $t=T_L$ (at the given time $T_L$), the golf ball lands on the ground which gives:

$$(V_o\sin\theta)T_L-\tfrac{1}{2}gT_L^2=0 \tag{7}$$

From the equation (7), the golf ball air traveling time can be determined as:

$$T_L = \frac{2\,Vo\sin\theta}{g} \tag{8}$$

From the equations (5) to (8), the golf ball traveling distance $X_L$ at a given $V_o$ and an elevation angle θ can be calculated by the following equation:

$$X_L = \frac{2\,Vo^2\sin\theta\cos\theta}{g} \tag{9}$$

Referring to FIG. 9, there is shown how the horizontal angle ϕ and the horizontal deviation d with respect to the center line 5 and the target flag 29 can be calculated. The symbol $D_L$ designates the ideal traveling distance from the tee 3 to the target flag 29 along the center line 5. The symbol dy designates the shortest distance from the golf ball landing point $t=T_L$ to a point M on the center line. The symbol dx designates the distance between M and the target flag. The symbol r designates the angle between d and dx. Thus, dx and dy can be calculated from the following equations:

$$dx=D_L-X_L\cos\phi \tag{10}$$

$$dy=X_L\sin\phi \tag{11}$$

From the equations (10) and (11), the angle r can be determined as follows:

$$\tan r = \frac{dy}{dx} = \frac{X_L\sin\phi}{D_L - X_L\cos\phi} \tag{12}$$

Since $X_L\sin\phi$ and $D_L-X_L\cos\phi$ are known, the angle r can be determined. Once the angle r is decided, the horizontal distance d can be ascertained by the following equation:

$$d = \frac{dy}{\sin r} = \frac{X_L\sin\phi}{\sin r} \tag{13}$$

The above described calculations are based primarily on the conditions excluding air friction, ball spin and wind effects which may, in the real world, modify the basic equations described herein. However, since these factors have been well developed in the classical aerodynamic, they can be added to the basic equations to further improve the practical accuracy of the calculation.

Figure 10:
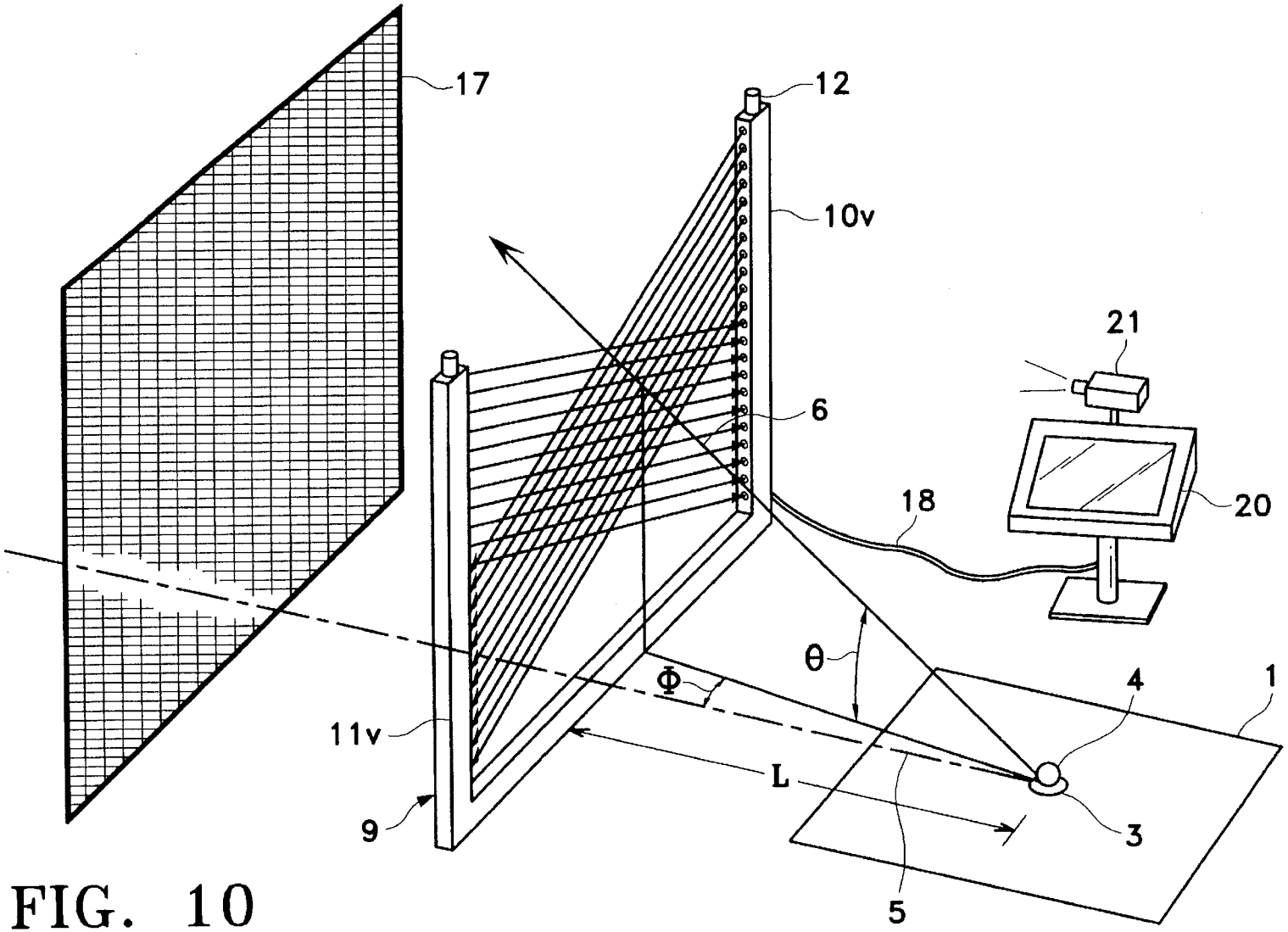
FIG. 10 is a slant view of a "U" shape golf training device.
Figure 11:
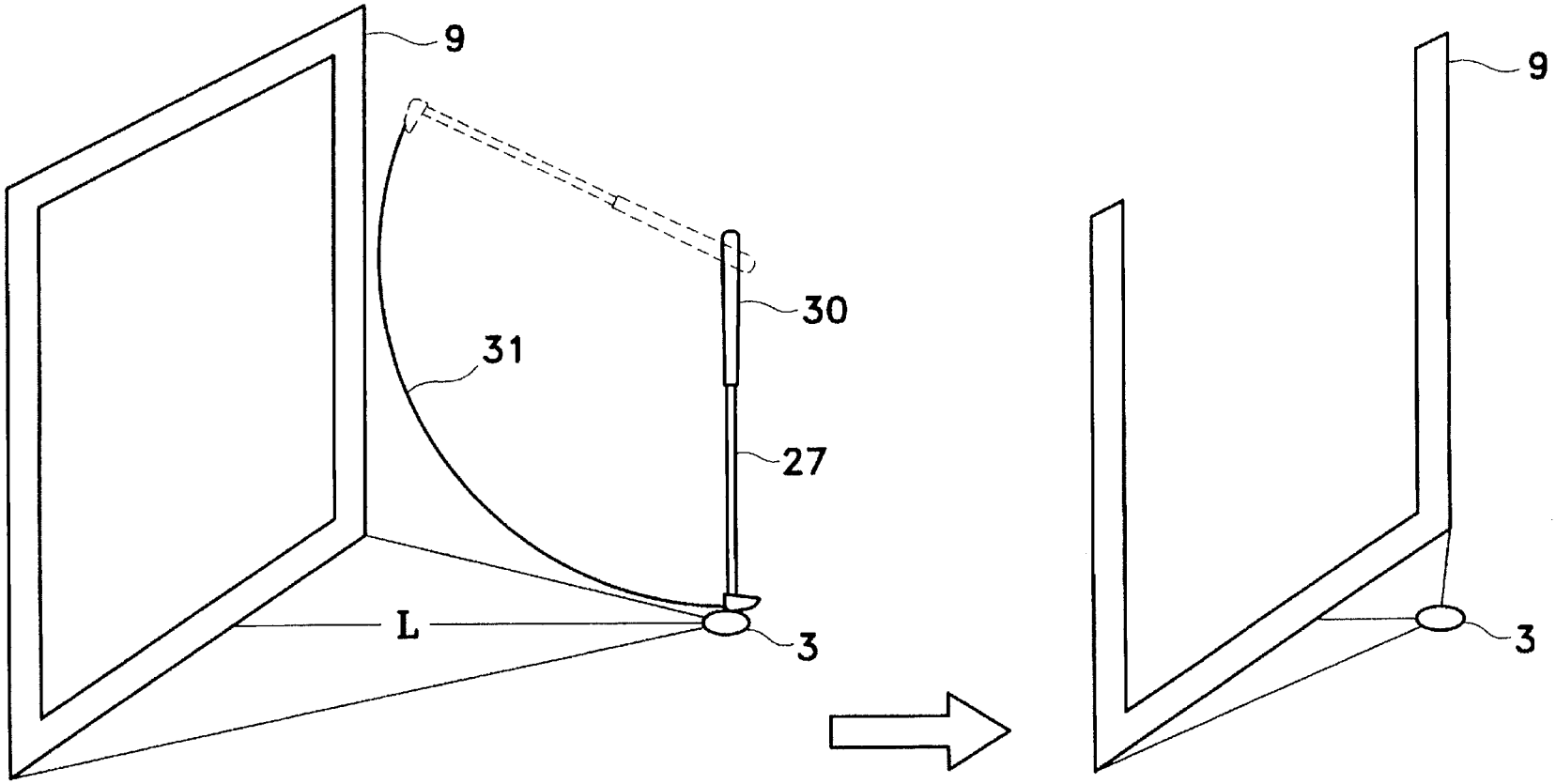
FIG. 11 is a diagram showing that a U-shape sensor net is able to eliminate the upper frame blockage of the golf swing.

Referring now jointly to FIGS. 10, 11, 12,13, 14, and 15, the construction of a two dimensional, highly symmetrical optical sensor net without the upper frame are described. As shown in FIG. 10, it is possible to build a golf training device substantially similar to the one illustrated in FIG. 1, but without the upper frame (i.e., an "U" or "Π" shape frame, or a substantially "U" or "Π" shape frame). The training device without the upper frame provides certain advantages as compared to the one with it. For instances, as shown in FIG. 11, the upper frame of 9 appears to be the major obstacle in reducing the size of the sensor net because the tee 3 must be placed at a distance L in front of the frame sufficient to accommodate a club swing path 31 due to the swinging of a club 27 by a golfer's arm 30. Consequently, a training device having a square frame must be constructed in a relatively larger dimension which is unsuitable for use of a non-laser or a diverging light source as the light producing means as described above. However, if the upper frame is removed to eliminate the blockage of the club swing, the distance between the sensor net and tee may be reduced dramatically as illustrated in FIG. 11. In addition, the dimension of the training device can be reduced accordingly which makes the use of a diverging point light source feasible without compromising its detection accuracy.

Figure 12:
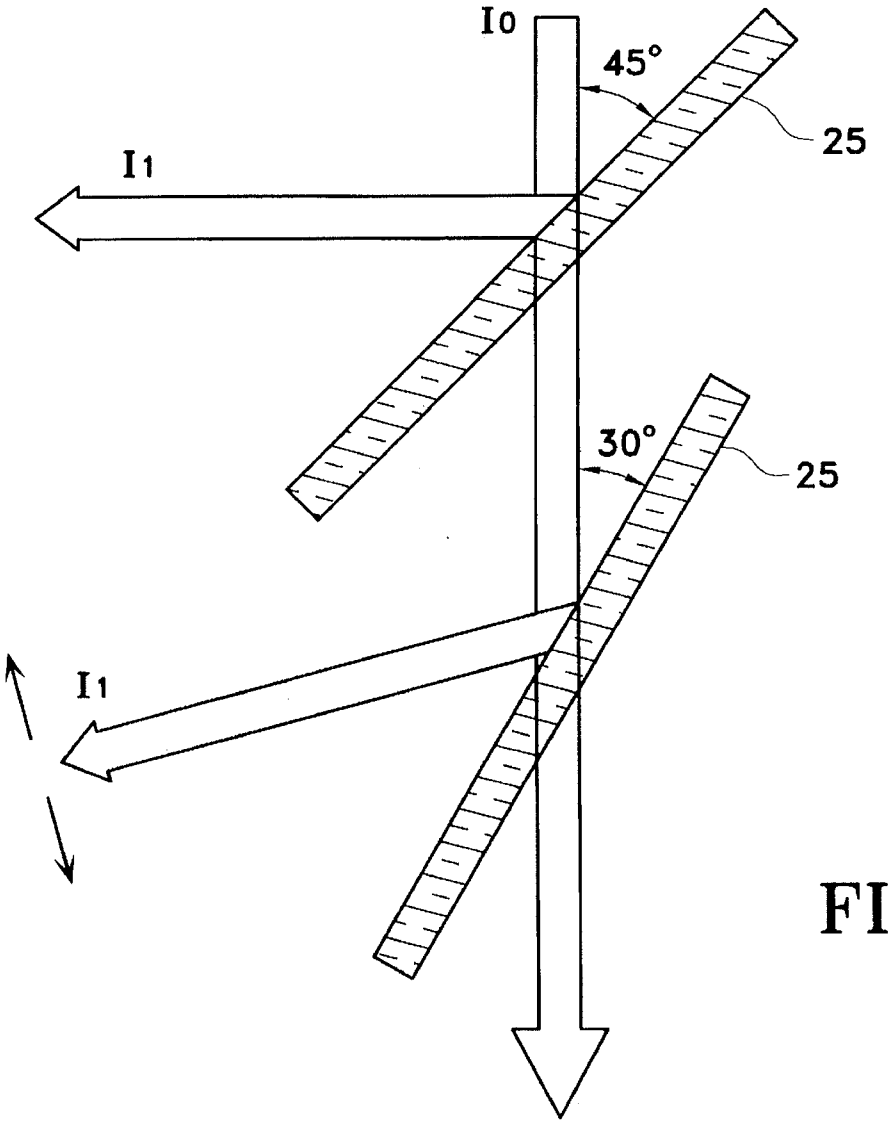
FIG. 12 is a diagram showing that the angle of the reflected laser light may be varied by changing the angle between the laser path and the light reflecting element.
Figure 13:
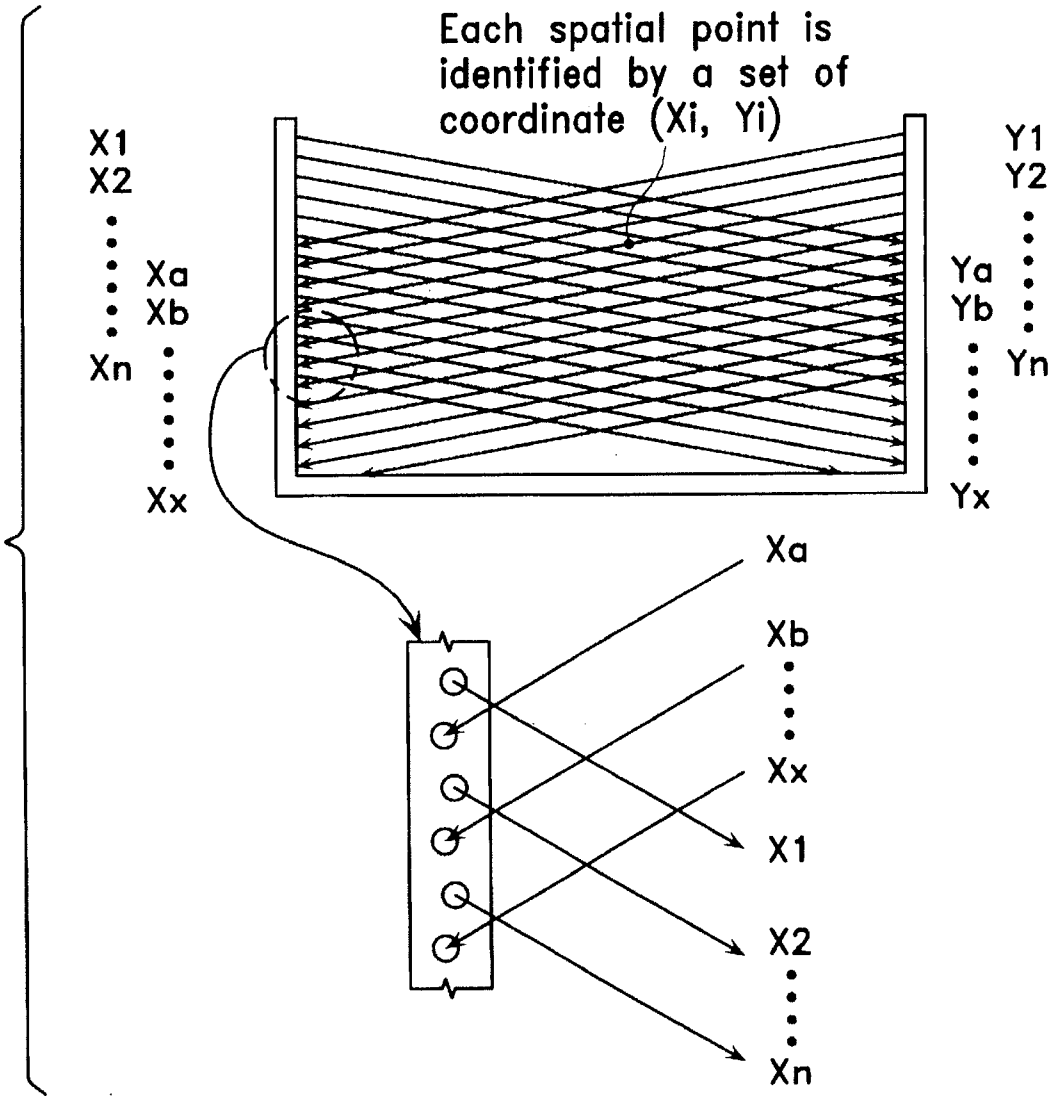
FIG. 13 illustrates an alternative way to construct a two-dimensional sensor net without a upper frame in which each spatial point is represented by an unique set of coordinate (Xi, Yj) which may intercept with each other at an angle other than 90 degree.
Figure 14A:
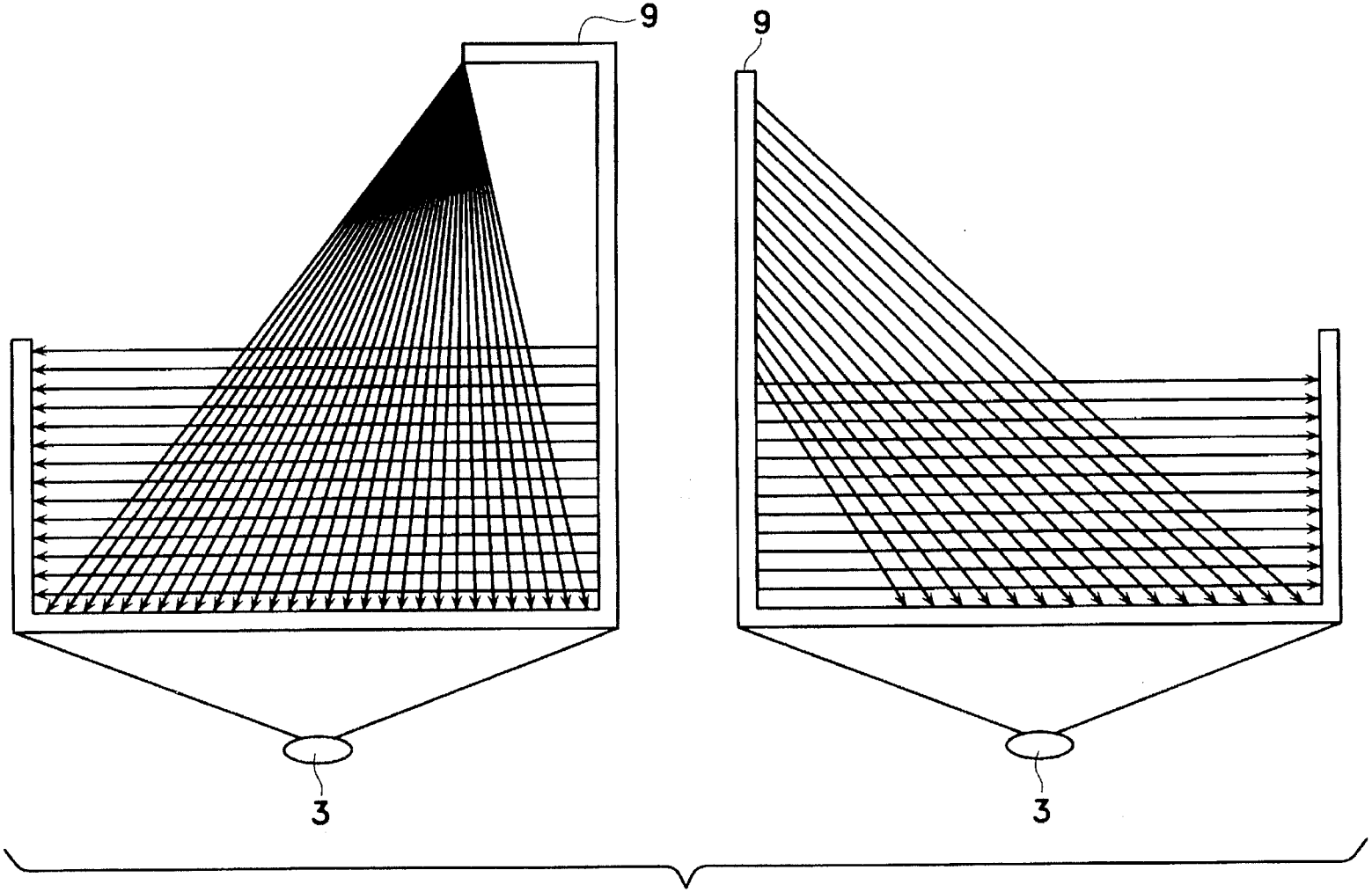
FIG. 14 illustrates the preferred arrangements of sensor nets without upper frame; (A) the detection elements are installed on the bottom frame and (B) the detection elements are not installed on the bottom frame.

In order to construct a two-dimensional, substantially symmetrical optical sensor net without the upper frame, the optical path must be re-arranged in a rotated angle as shown in FIG. 13. This rotation may be achieved by simultaneously rotating both X and Y axes of the optical net as illustrated in the upper graph of FIG. 13, or use of a combination of diverging point source and rotating axis. Some examples of possible configuration are depicted in FIGS. 14 and 15. As shown in FIG. 13, each spatial point of the optical net is represented by an unique set of coordinate (Xi, Yj). However, unlike the square frame training device whose X and Y coordinates intercepting each other at 90 degrees (FIGS. 1 and 6), the X and Y coordinates of a "U" or "Π" shape training device may intercept each other at an angle other than 90 degrees. This can be achieved by adjusting the angle of the light emitting/reflecting elements (i.e., glass slides). As shown in FIG. 12, if a glass slide 25 is installed at a 45 degrees reflection angle as referencing to the entering laser beam Io, the X and Y coordinates of the optical net will intercept each other at 90 degrees. However, if the glass slide 25 is installed at a 30 degree reflection angle, the X and Y coordinates of the optical net will intercept at an angle other than 90 degrees. Thus, the angle of reflection may be varied by adjusting the angle of the light emitting/reflecting elements to produce an array of optical paths with various emitting angles.

Figure 14B:
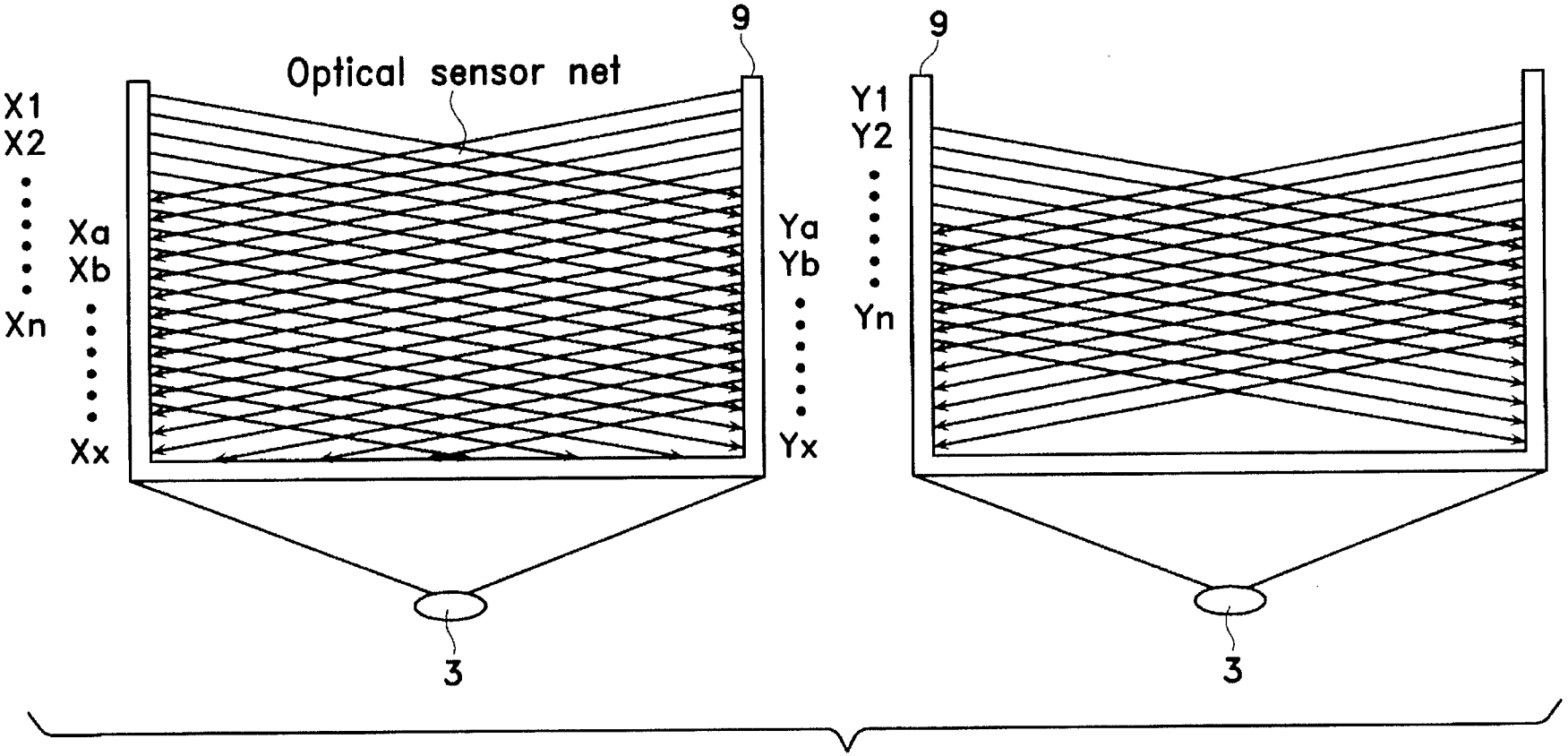
Figure 15:
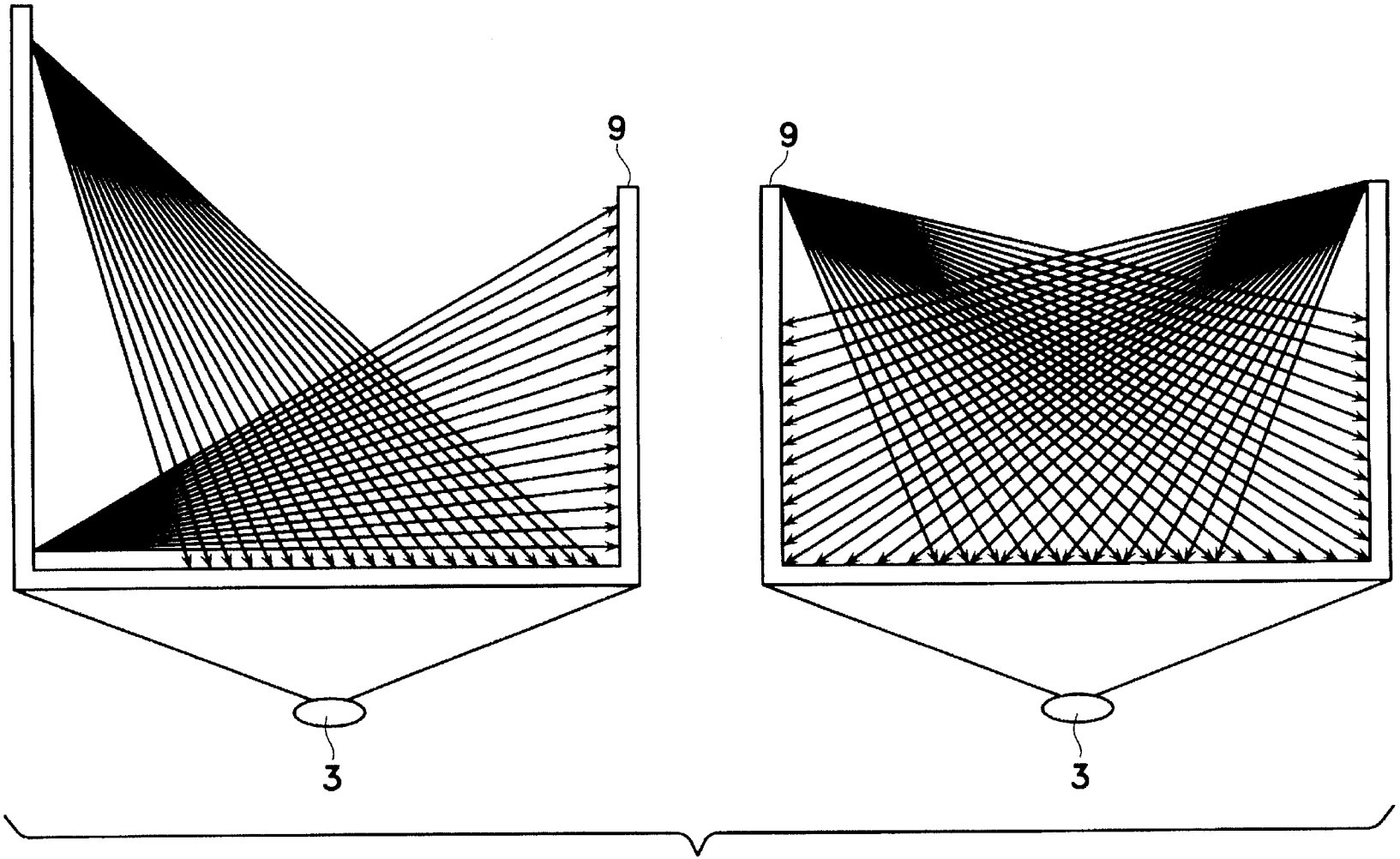
FIG. 15 illustrates the use of diverging point sources to construct a sensor net without the upper frame.

Referring to FIG. 14, a number of preferred "U" or substantially "U" arrangements are shown where a spatially uniform and symmetric sensor net is constructed with either two vertical frames or two vertical frames and the bottom frame. As illustrated in FIG. 14(B), a "U" shape or substantially "U" shape (i.e. it also applies to a "Π" shape or substantially "Π" shape frame) has a first vertical side and a second vertical side and a bottom side in that said vertical sides are perpendicular or substantially perpendicular to the bottom side or to the ground to which the frame is fixed. Each of the vertical sides is provided with a signal producing means (not shown) and its respective emitting means X1, X2, . . . Xn or Y1, Y2, . . . Yn and a signal detecting means Xa, Xb, . . . Xx or Ya, Yb, . . . Yx. As shown in the bottom graph of FIG. 13, on each of the vertical side, the light signal producing means and its respective emitting means X1, X2, Xn is adjustably placed on the frame with the detecting means Xa, Xb, Xx in that the light detecting means is being arranged in substantial alignment with and in close proximity, with a distance smaller than the diameter of a golf ball, to the light emitting means on each vertical sides of the frame to form a substantially symmetrical optical sensor net in which the light signals emitting from the different sides of the frame are intercepted at an angle other than 90 degrees in that any area of the net has substantially the same density.

As illustrated in FIG. 14(A), a "U"-shape or substantially "U"-shape frame in which at least one of its vertical sides is provided with at least one signal producing means and the bottom side and the other vertical side are respectively provided with a signal detecting means. The light signal producing means are adjustably placed on the signal producing means holding part of the respective vertical sides of the frame to emit, including means to emit multiple light signals to generate a two-dimensional, optical net wherein the light signals are intercepted at an angle other than 90 degrees in that any area of the net has substantially the same density. The light signal detecting means, including means to output a detection signal, are adjustably placed on the respective signal detecting means holding part of the frame and the detecting means is so arranged as to receive and detect light signals from the light signal producing means to form a substantially symmetrical optical sensor net.

If a diverging point light source is used in constructing the two-dimensional sensor net, both the detection area and golf ball impact spatial resolution will be largely compromised as evident form FIG. 15. This compromise, however, can be minimized by eliminating the upper frame of the sensor net to reduce the distance between the tee and the optical net and the size of the optical net. If the distance between the light emitting element and detector is reduced to below 2 feet or so, an array of narrowly focused infrared LEDs or white light sources may be used, instead of a laser, for generating the optical path of the sensor net without compromising detection accuracy. This arrangement makes the use of non-coherent light sources, besides the laser, feasible and cost effective.

We claim:

1. A golf training device having a two-dimensional, single planar and total symmetrical optical sensor net for detecting movement of a golf ball impacted to display data on the ball, comprising:

a golf ball sensor means placed on a reference axis of a golf ball traveling direction for detection of a golf ball movement at initial impact;

a square frame placed further along the golf ball traveling direction with respect to the golf ball sensor means, said square frame having a signal producing means holding part to support a light signal producing means on a first horizontal and a first vertical sides of the square frame and a signal detecting means holding part to support a light signal detecting means on a second horizontal and a second vertical sides of the square frame wherein the first horizontal and first vertical sides forming a first right angle diagonally above and opposed to a second right angle formed between the second horizontal and second vertical sides with respect to the golf ball sensor means;

a light emitting means adapted to said light signal producing means to emit multiple light signals produced from a beam of light from one focused light source to generate a two-dimensional, single planar optical net wherein the multiple light signals emitting from the first horizontal and first vertical sides of the square frame are perpendicularly intercepted in that any area of the optical net in which the golf ball interrupts has a uniform density;

a means to output a detection signal adapted to said light signal detecting means; said light signal detecting means being symmetrically arranged in accordance with the light emitting means to form a totally symmetrical optical sensor net for detecting the multiple light signals emitting from the light emitting means; said optical sensor net having a dimension no less than 4 feet;

a data processing means which receives and processes output signals from the light signal detecting means based on a movement of the golf ball; and a display means to display data generated from the movement of said golf ball.

2. A golf training device according to claim 1 wherein the light signal detecting means comprises a series of detectors on the second horizontal and the second vertical sides of the signal detecting means holding part, said detectors are spatially arranged in accordance with the glass slides or prisms to form a symmetrical optical sensor net to receive light signals produced by the laser beam.

3. A golf training device according to claim 1 wherein the light signal producing means comprises a focused laser beam and an optical splitter, said optical splitter has a function of splitting a beam of light produced by the focused laser beam equally to the light emitting means located on the first horizontal and the first vertical sides of the light signal producing means holding part.

4. A golf training device according to claim 3 wherein the light emitting means comprises a series of glass slides or prisms equally spaced at a predetermined distance on the first horizontal and the first vertical sides of the signal producing means holding part to receive and emit light signals produced by the focused laser beam, said predetermined distance being smaller than a diameter of a golf ball.

5. A golf training device according to claim 4 wherein the glass slides or prisms are further coated with different scales of anti-reflection coatings to control and obtain different laser intensity reflections.

6. A golf training device according to claim 4 wherein the thickness of the glass slides is be adjusted to minimize laser light divergence and to avoid multiple reflections by said slides.

7. A golf training device according to claim 3 wherein the laser beam is pulsed and the detector is filtered to differentiate the light signals produced by ambient illumination from those produced by the golf ball crossing interruption.

8. A golf training device according to claim 1 wherein the data processing means includes a separation means for separating a detection signal which is outputted from the interception of the golf ball with the optical net, from a detection signal outputted from the golf ball sensor pad when the ball is initially impacted.

9. A golf training device of claim 1 further comprises a golf ball stopping net placed along the golf ball traveling direction at rear of the optical net for ball stopping.

10. A golf training device of claim 9 further comprises a projector to project a realistic picture or a simulated golf course image onto the golf ball stopping net.

11. A golf training device of claim 1 wherein the preferred dimensions of the optical net are between 4 to 8 feet.

12. A golf training device having a two-dimensional, single planar and total symmetrical optical sensor net for detecting movement of a golf ball impacted to display data on the ball, comprising:

a golf ball sensor means placed on a reference axis of a golf ball traveling direction for detection of a golf ball movement at initial impact;

a square frame placed further along the golf ball traveling direction with respect to the golf ball sensor means, said square frame having a signal producing means holding part to support a light signal producing means on a first horizontal and a first vertical sides of the square frame and a signal detecting means holding part to support a signal detecting means on a second horizontal and a second vertical sides of the frame wherein the first horizontal and first vertical sides forming a first right angle diagonally above and opposed to a second right angle formed between the second horizontal and second vertical sides with respect to the golf ball sensor means;

a light emitting means adapted to said light signal producing means to emit multiple light signals produced from a beam of light from said light signal producing means which comprises a focused laser beam and an optical splitter wherein said light emitting means comprises a series of glass slides equally spaced at a predetermined distance smaller than a diameter of a golf ball on the first horizontal and the first vertical sides of the signal producing means holding part to transmit and emit the multiple light signals produced by the focused laser beam to generate a two-dimensional, single planar optical net wherein the light signals in any area of the optical net in which the golf ball intercepts have a uniform density;

a means to output a detection signal adapted to said light signal detecting means; said light signal detecting means comprises a series of detectors on the second horizontal and the second vertical sides of the signal detecting means holding part, said detectors are spatially arranged in accordance with the glass slides to form a totally symmetrical optical sensor net for detecting the multiple light signals emitting from the light emitting means; said optical sensor net having a dimension no less than 4 feet;

a data processing means which receives and processes output signals from the light signal detecting means based on a movement of the golf ball; and a display means to display data generated from the movement of said golf ball.

13. A golf training device having an area of two-dimensional, symmetrical optical sensor net for detecting movement of a golf ball impacted to display data on the ball, comprising:

a golf ball sensor means placed on a reference axis of a golf ball traveling direction for detection of a golf ball movement at initial impact;

a "II" type parallel frame or an "U" shape frame placed further along the golf ball traveling direction with respect to the golf ball sensor means, said "II" shape parallel frame having a first vertical side and a second vertical side wherein said first vertical side and second vertical side are parallel to each other, yet perpendicular to a ground defined by the reference axis of the golf ball traveling direction and said "U" shape frame having, in addition to a first vertical side and a second vertical side, a bottom side in that said vertical sides are perpendicular to the bottom side or to a ground to which the bottom side of the "U" shape frame is fixed wherein each of said first and second vertical sides of the "II" shape parallel frame and the "U" shape frame is provided with a light signal producing means holding part to hold and support a light signal producing means and a light signal detecting means holding part to hold and support a light signal detecting means;

a light emitting means adapted to said light signal producing means to emit multiple light signals produced from a beam of light from one focused light source to generate a two-dimensional optical net wherein the multiple light signals emitting from different sides of the frame are intercepted at an angle other than 90 degrees in that any area of the net in which the golf ball interrupts has a uniform density;

a means to output a detection signal adapted to said light signal detecting means; said light signal detecting means being arranged in alignment with and in close proximity, with a distance smaller than a diameter of a golf ball, to the light emitting means on each vertical sides of the frame to form an area of symmetrical optical sensor net for detecting the multiple light signals emitting from the light emitting means; said optical sensor net having a dimension no less than 2 feet;

a data processing means which receives and processes output signals from the light signal detecting means based on a movement of the golf ball; and a display means to display data generated from the movement of said golf ball.

14. A golf training device according to claim 13 wherein the light signal producing means comprises a focused laser beam on each of the vertical sides, said focused laser beam produces a beam of light received and transmitted by the light signal emitting means located on the vertical sides of the light signal producing means holding part.

15. A golf training device according to claim 13 wherein the data processing means includes a separation means for separating a detection signal which is outputted from the interception of golf ball with the optical net, from a detection signal outputted from the golf ball sensor pad when the ball is initially impacted.

16. A golf training device of claim 13 further comprises a golf ball stopping net placed along the golf ball traveling direction at the rear of the optical net for ball stopping.

17. A golf training device according to claim 13 wherein the light signal emitting means comprises a series of glass slides or prisms equally spaced at a predetermined distance on the first and the second vertical sides of the signal producing means holding part to receive and emit light signals produced by a focused laser beam, said predetermined distance being smaller than a diameter of a golf ball.

18. A golf training device according to claim 17 wherein the light signal detecting means comprises a series of detectors on the first and the second vertical sides of the signal detecting means holding part, said detectors are spatially arranged in accordance with the glass slides or prisms to form a symmetrical optical sensor net to receive light signals produced by the focused laser beam.

19. A golf training device having an area of two-dimensional, symmetrical optical sensor net for detecting movement of a golf ball impacted to display data on the ball, comprising:

a golf ball sensor means placed on a reference axis of a golf ball traveling direction for detection of a golf ball movement at initial impact;

an "U"-shape or, in the alternative, a substantially "U"-shape frame placed further along the golf ball traveling direction with respect to the golf ball sensor means, said frame having a first and a second vertical sides and a bottom side in which said vertical sides are an equal length and perpendicular to said bottom side for the "U" shape frame and in which said vertical sides are in unequal length and perpendicular to said bottom side for the substantially "U" shape frame wherein at least one of said vertical sides is provided with at least one light signal producing means holding part to hold and support at least a light signal producing means and wherein the bottom side and one of the vertical sides are respectively provided with a light signal detecting means holding part to hold and support a light signal detecting means;

a light emitting means adapted to said light signal producing means to emit multiple light signals produced from a beam of light from one focused light source to generate a two-dimensional, optical net wherein the multiple light signals are intercepted at an angle other than 90 degrees in that any area of the net in which the golf ball interrupts has a similar density;

a means to output a detection signal adapted to said light signal detecting means; said light signal detecting means being so arranged as to receive and detect the multiple light signals emitting from the light emitting means to form an area of symmetrical optical sensor net; said optical sensor net having a dimension no less than 2 feet;

a data processing means which receives and processes output signals from the light signal detecting means based on a movement of the golf ball; and a display means to display data generated from the movement of said golf ball.

20. A golf training device according to claim 19 wherein the light signal detecting means comprises a series of detectors on the respective signal detecting means holding part, said detectors are spatially arranged in accordance with the respective light signal producing means or light signal emitting means to form a symmetrical optical sensor net to receive light signals produced by a laser beam.

21. A golf training device according to claim 19 wherein the data processing means includes a separation means for separating a detection signal which is outputted from interception of a golf ball with the optical net, from a detection signal outputted from the golf ball sensor pad when the ball is initially impacted.

22. A golf training device of claim 19 wherein the vertical side having at least one light signal producing means is provided with a first and second separately installed light producing means to separately provide light signals to the respective signal detecting means on the other vertical side and the bottom side.

23. A golf training device of claim 21 wherein the light signal producing means is a focused laser light source or a combination of a focused laser light source and a non-coherent LED, white light.

24. A golf training device according to claim 23 wherein each of the laser light sources comprises a focused laser beam and an optical splitter having a function of splitting the light signals produced by the laser beam equally to the light signal emitting means located on the respective light signal producing means holding part.

25. A golf training device according to claim 24 wherein the light signal emitting means comprises a series of glass slides or prisms equally spaced at a predetermined distance on the respective light signal producing means holding part to receive and emit light signals produced by the laser beam, said predetermined distance being smaller than a diameter of a golf ball.

26. A golf training device of claim 19 further comprises a golf ball stopping net placed along the golf ball traveling direction at the rear of the optical net for ball stopping.

* * * * *